US008499377B2

(12) United States Patent
Fafard et al.

(10) Patent No.: US 8,499,377 B2
(45) Date of Patent: Aug. 6, 2013

(54) AUTOMATICALLY ADJUSTABLE BUNK

(75) Inventors: Michael J. Fafard, Nashville, GA (US); Michael Anthony Werle, Nashville, GA (US)

(73) Assignee: Chaparral Boats, Inc., Nashville, GA (US)

( * ) Notice: Subject to any disclaimer, the term of this patent is extended or adjusted under 35 U.S.C. 154(b) by 731 days.

(21) Appl. No.: 12/506,453

(22) Filed: Jul. 21, 2009

(65) Prior Publication Data

US 2011/0017120 A1 Jan. 27, 2011

(51) Int. Cl.
*A47C 17/58* (2006.01)
*A47C 17/62* (2006.01)

(52) U.S. Cl.
USPC ..... 5/9.1; 5/3

(58) Field of Classification Search
USPC ..... 5/9.1, 3–5, 118
See application file for complete search history.

(56) References Cited

U.S. PATENT DOCUMENTS 3,246,347 A * 4/1966 Mason ..... 5/9.1
3,427,667 A * 2/1969 Ratcliff ..... 5/3
3,636,892 A * 1/1972 Linton ..... 5/3
4,926,783 A * 5/1990 Lathers ..... 114/363
7,207,076 B2 * 4/2007 Gardner ..... 5/9.1
2004/0187206 A1 9/2004 Devlin
2005/0217021 A1 * 10/2005 Gardner ..... 5/9.1
2008/0129086 A1 6/2008 Holmes et al.
2011/0017120 A1 * 1/2011 Fafard et al. ..... 114/343

FOREIGN PATENT DOCUMENTS

EP 0916290 A2 5/1999

OTHER PUBLICATIONS

International Search Report and written opinion issued in PCT/US2010/042460, mailed Dec. 27, 2010, 9 pages.

* cited by examiner

*Primary Examiner* — Robert G Santos
(74) *Attorney, Agent, or Firm* — Fish & Richardson P.C.

(57) ABSTRACT

Automatically adjustable bunk apparatus are described that can be used, for example, in applications in which space is limited, such as, for example, boats and recreational vehicles. The automatically adjustable bunk apparatus can be configured in an extended bunk configuration or a space saving retracted configuration. The automatically adjustable bunk apparatus have a substantially horizontal portion and an adjustable portion either of which can be configured to be movable between a retracted position and an extended position. When the automatically adjustable bunk apparatus is in its retracted configuration, the adjustable portion is positioned outside the plane of the horizontal portion, and when the automatically adjustable bunk apparatus is in its extended position, the horizontal portion and the adjustable portion form a substantially flat surface.

27 Claims, 7 Drawing Sheets

AUTOMATICALLY ADJUSTABLE BUNK

BACKGROUND

In some environments, such as, for example, on a boat, space can be at a premium. Space minimizing and convertible furnishings are sometimes developed for such environments of limited space so that multiple functions can be performed or multiple activities accomplished in a fixed amount of space. Examples of such space minimizing and convertible furnishings include a dining table that can be converted into a bunk, a seat with storage space built into the seat base, and a seat with a seating portion that folds out of the way when not in use.

SUMMARY

Automatically adjustable bunk apparatus that are adjustable between an extended configuration and a retracted configuration are described. These automatically adjustable bunk apparatus include a substantially horizontal portion and an adjustable portion. The adjustable portion is moveable between a retracted position and an extended position (the horizontal portion also can be configured to be moveable between a retracted position and an extended position). When the adjustable portion is in the retracted position, i.e., the automatically adjustable bunk apparatus is in its retracted configuration, the adjustable portion is positioned outside, i.e., either above or below, the plane of the horizontal portion. The horizontal portion and adjustable portion form a substantially flat surface, i.e., the bunk surface, when the moveable components of the automatically adjustable bunk apparatus are in their respective extended positions, i.e., the automatically adjustable bunk apparatus is in an extended configuration. When the automatically adjustable bunk apparatus is in its retracted configuration, a portion of the floor area over which the automatically adjustable bunk apparatus is positioned when in its extended configuration is exposed to provide additional floor area.

An additional automatically adjustable bunk apparatus that is adjustable between an extended configuration and a retracted configuration includes a substantially horizontal portion and an adjustable portion pivotally attached to the horizontal portion. The adjustable portion is moveable between a retracted position and an extended position (the horizontal portion also can be configured to be moveable between a retracted position and an extended position). The automatically adjustable bunk apparatus includes an automatic adjuster for adjusting the position of the moveable components of the automatically adjustable bunk apparatus and a controller operatively interconnected with the automatic adjuster for controlling the configuration of the automatically adjustable bunk apparatus. When the adjustable portion is in the retracted position, i.e., the automatically adjustable bunk apparatus is in its retracted configuration, the adjustable portion is positioned outside the plane of the horizontal portion. The horizontal portion and adjustable portion form a substantially flat surface, i.e., the bunk surface, when the moveable components of the automatically adjustable bunk apparatus are in their respective extended positions, i.e., the automatically adjustable bunk apparatus is in an extended configuration. When the automatically adjustable bunk apparatus is in its retracted configuration, a portion of the floor area over which the automatically adjustable bunk apparatus is positioned when in the extended configuration is exposed to provide additional floor area.

DESCRIPTION OF DRAWINGS

Like reference symbols in the various drawings indicate like elements.

DETAILED DESCRIPTION

Automatically adjustable bunk apparatus are described. These automatically adjustable bunk apparatus can be used, for example, in applications in which space is limited, such as, for example, boats and recreational vehicles. The term automatically adjustable, when used to describe the bunk apparatus disclosed herein, is intended to mean that the bunk is not required to be manually adjusted by an operator, i.e., no physical pushing or pulling of the bunk is required by the operator. Rather, the bunk is automatically adjusted through an interaction with a controller that controls the position of the adjustable portion of the bunk. The automatically adjustable bunk apparatus can be configured in an extended bunk configuration or a space saving retracted configuration. The automatically adjustable bunk apparatus have a substantially horizontal portion and an adjustable portion either of which can be configured to be movable between a retracted position and an extended position. When the adjustable portion is in the retracted position, i.e., the automatically adjustable bunk apparatus is in its retracted configuration, the adjustable portion is positioned outside the plane of the horizontal portion, and when the automatically adjustable bunk apparatus is in its extended configuration the horizontal portion and the adjustable portion form a substantially flat surface. As used herein, the term outside the plane of the horizontal portion is intended to mean a position above or below the plane of the horizontal portion. The automatically adjustable bunk apparatus can include cushions on the horizontal and adjustable portions to form a sleeping area. Further, the floor area over which the automatically adjustable bunk apparatus is positioned when the automatically adjustable bunk apparatus is in its extended configuration is exposed when the automatically adjustable bunk apparatus is in its retracted configuration.

Figure 1A:
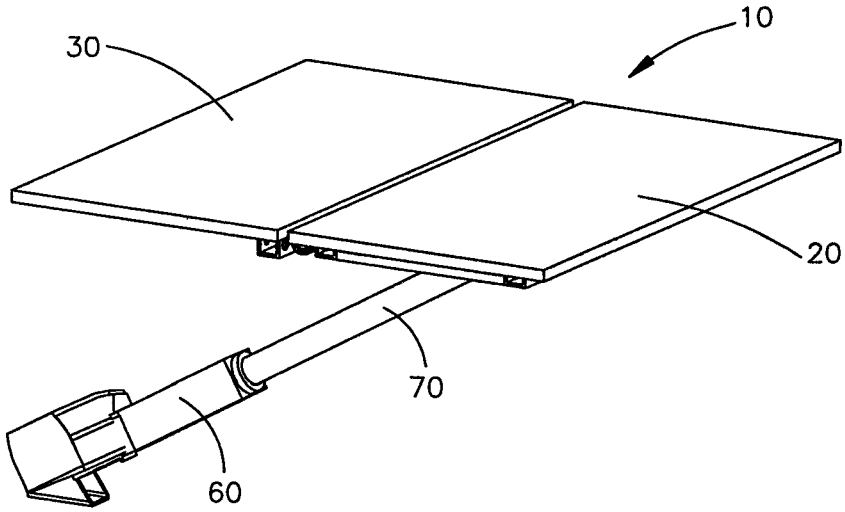
FIGS. 1A, 1B, and 1C are perspective views of an automatically adjustable bunk apparatus with the adjustable portion in an extended position, i.e., configured as a substantially flat surface (FIG. 1A), with the adjustable portion in an intermediate position between a retracted position and an extended position (FIG. 1B), and with the adjustable portion in a retracted position (FIG. 1C).
Figure 1B:
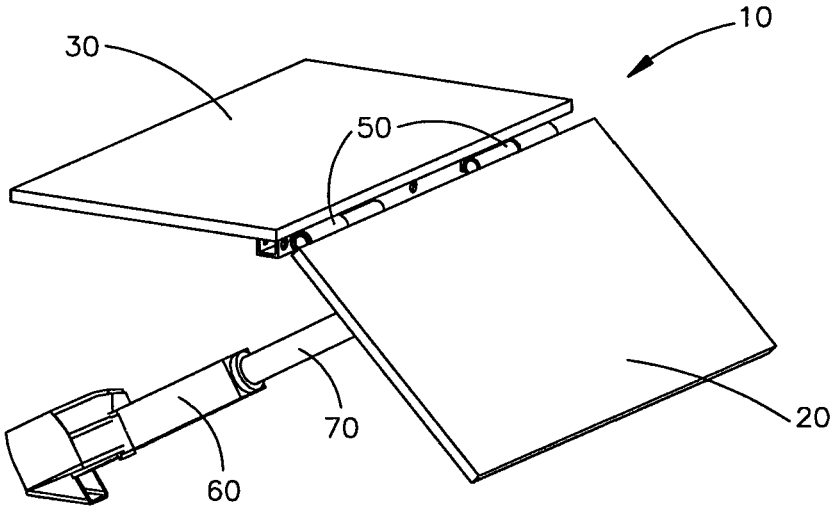
Figure 1C:
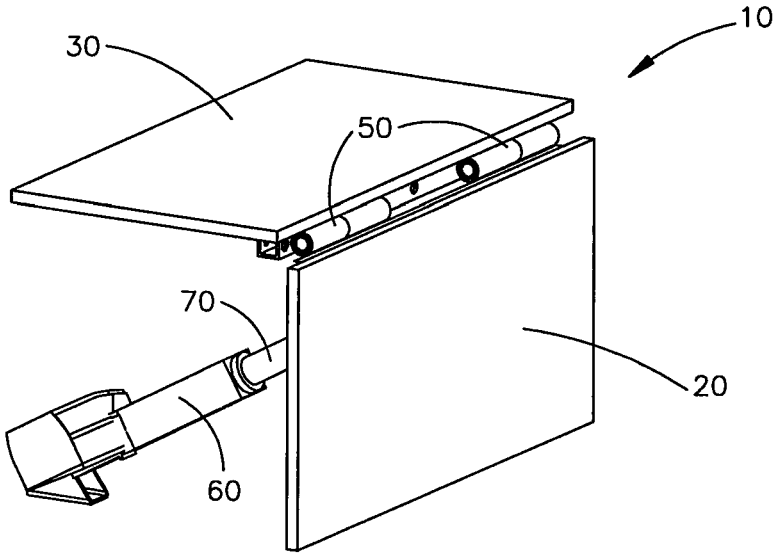
Figure 2A:
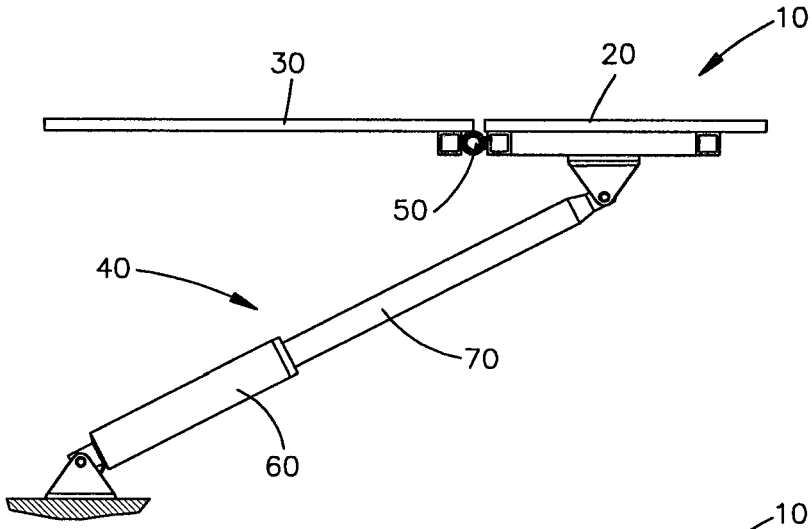
FIGS. 2A, 2B, and 2C are side views of an automatically adjustable bunk apparatus with the adjustable portion in an extended position, i.e., configured as a substantially flat surface (FIG. 2A), with the adjustable portion in an intermediate position between a retracted position and an extended position (FIG. 2B), and with the adjustable portion in a retracted position (FIG. 2C).
Figure 2B:
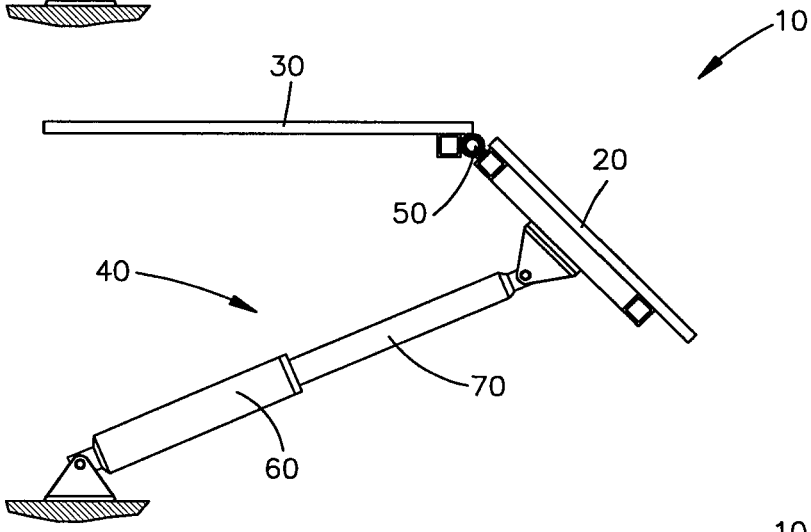
Figure 2C:
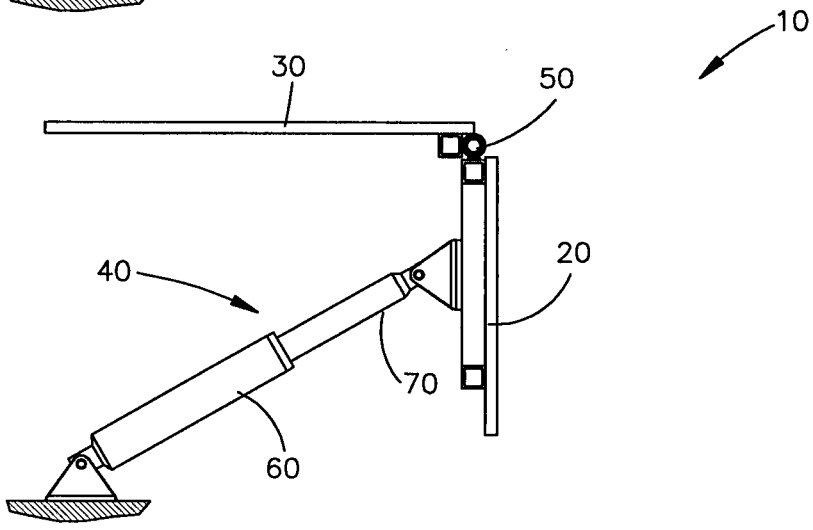

As shown in FIGS. 1A-C and 2A-C, in one example, the automatically adjustable bunk apparatus 10 has an adjustable portion 20 that can be, but is not necessarily, hingedly attached to the horizontal portion 30 of the automatically adjustable bunk apparatus 10. FIGS. 1A-C show a perspective view of the adjustable portion 20 of the automatically adjustable bunk apparatus 10, adjusting from an extended position (as shown in FIG. 1A) through an intermediate position (as shown in FIG. 1B) to a retracted position (as shown in FIG. 1C). FIGS. 2A-C similarly show a side view of the adjustable portion 20 of the automatically adjustable bunk apparatus 10, adjusting from an extended position (as shown in FIG. 2A) through an intermediate position (as shown in FIG. 2B) to a retracted position (as shown in FIG. 2C). When the adjustable portion 20 is in a retracted position as shown in FIGS. 1C and 2C, the adjustable portion 20 is positioned outside the plane of the horizontal portion 30 and substantially perpendicular to the horizontal portion 30. FIG. 2 also shows an automatic adjuster 40 that is operative to move the adjustable portion 20 from the extended position (e.g., FIG. 2A) to a retracted position (e.g., FIG. 2C) through a range of intermediate positions (one of which is shown in FIG. 2B). FIGS. 1A-C are shown with three hinges 50, however, as used herein the term hingedly attached is intended to include the use of a single or multiple hinges. While shown as a solid section in FIGS. 1A-C and 2A-C, the adjustable portion 20 can include, for example, a frame upon which a cushion or other structure can be mounted such that the components that form the adjustable portion 20 and the horizontal portion 30 form a substantially flat surface when the adjustable portion 20 is in the extended position.

The automatic adjuster 40 can include an actuator 60 that is used to drive or actuate a driving portion 70. An actuator can be, for example, a pneumatic actuator, a hydraulic actuator, or an electric motor actuator. The driving portion can be, for example, a shaft, rod, chain, or cable. As shown in FIGS. 2A-C, the automatic adjuster can include an actuator 60 and a shaft 70 that can be, for example, a shaft or threaded rod depending on the mechanism of the automatic adjuster 20.

Figure 3:
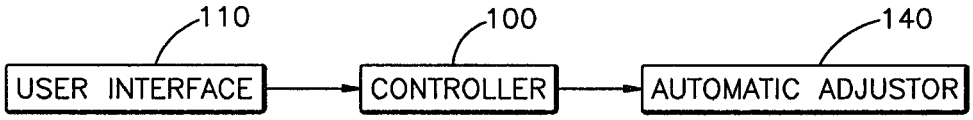
FIG. 3 is a schematic view of a control system for an automatically adjustable seating apparatus such as the automatically adjustable seating apparatus shown in FIGS. 1A-C and 2A-C.

The automatic adjuster 40 is operatively interconnected to a controller 100, shown in FIG. 3. The controller 100 has hardware and/or software configured for operation of the automatic adjustor 40, and may comprise any suitable programmable logic controller or other control device, or combination of control devices, that is programmed or otherwise configured to perform as recited in the claims. Specifically, the controller 100 controls the automatic adjuster 40 to move the adjustable portion 20 between the retracted position and the extended position as shown in FIGS. 1A-C and 2A-C. The controller 100 includes a user interface 110, which allows an operator to operate the automatically adjustable bunk apparatus 10. The user interface 110 can be one or more devices with which a user can interact, such as, for example, switches, buttons, toggle switches, a computer controlled touch pad, or combinations thereof. The operation of the automatic adjuster 40 can be controlled by a single or multiple user interfaces 110, e.g., one or more switches. When more than one user interface 110 is used, the user interfaces 110 can be located at different positions, e.g., the foot of the bunk, the head of the bunk, and/or another locations from which a user may desire to control the bunk. The controller 100 can provide a user with the ability to select one or more pre-selected positions for the automatically adjustable bunk apparatus 10. Further, the controller 100 can provide a user with the ability to adjust the automatically adjustable bunk apparatus 10 to maintain a configuration between the retracted and extended configurations, such as a configuration shown in FIGS. 1B and 2B.

Figure 4A:
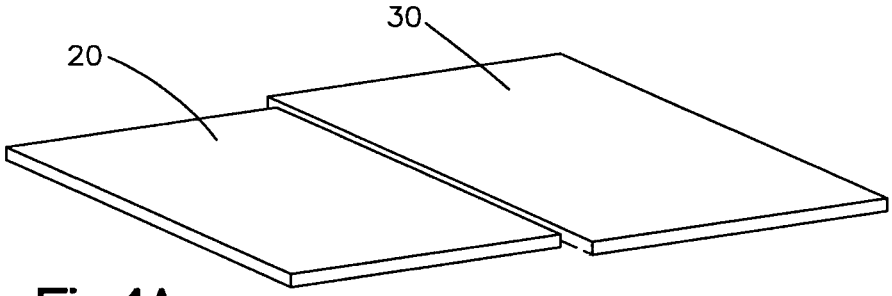
FIGS. 4A, 4B, and 4C are perspective views of an automatically adjustable bunk apparatus with the adjustable portion in an extended position, i.e., configured as a substantially flat surface (FIG. 4A), with the adjustable portion in an intermediate position between a retracted position and an extended position (FIG. 4B), and with the adjustable portion in a retracted position (FIG. 4C).
Figure 4B:
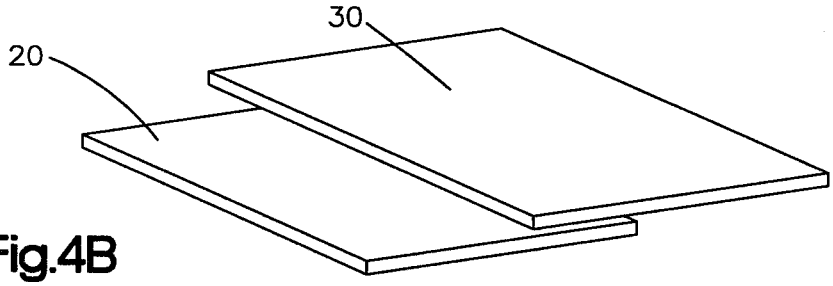
Figure 4C:
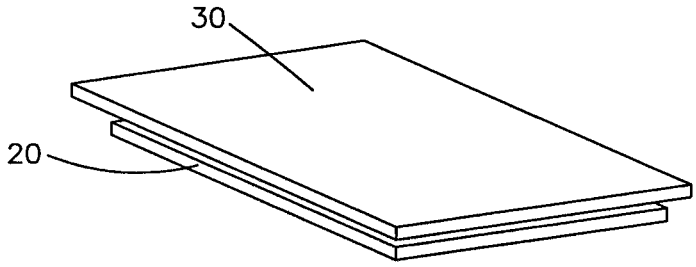
Figure 5A:
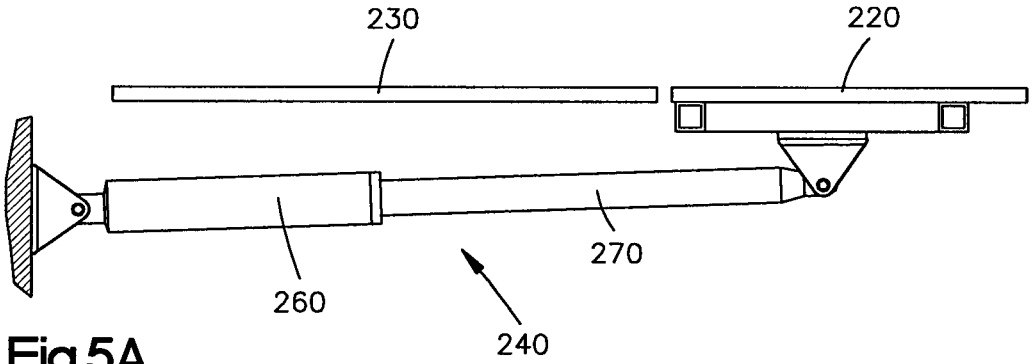
FIGS. 5A, 5B, and 5C are side views of an automatically adjustable bunk apparatus with the adjustable portion in an extended position, i.e., configured as a substantially flat surface (FIG. 5A), with the adjustable portion in an intermediate position between a retracted position and an extended position (FIG. 5B), and with the adjustable portion in a retracted position (FIG. 5C).
Figure 5B:
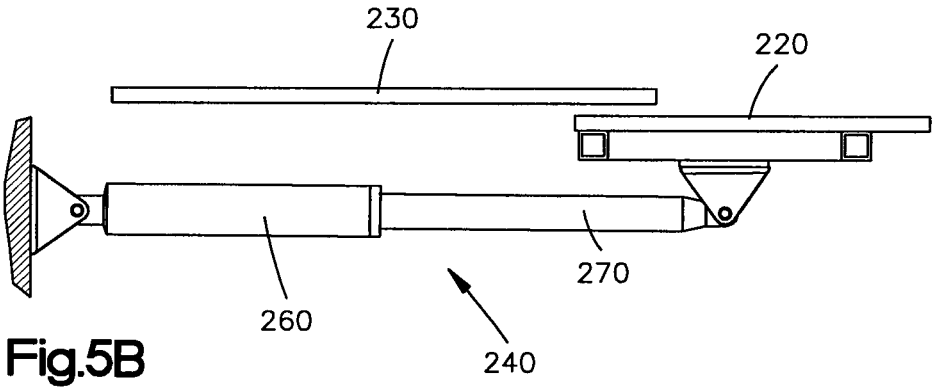
Figure 5C:
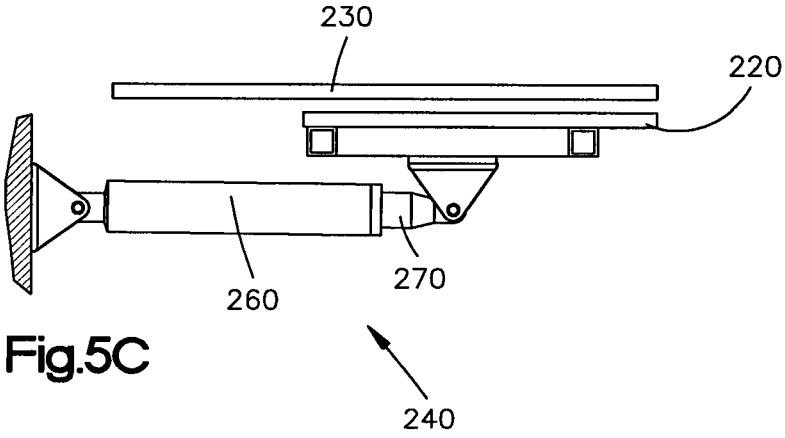

A further example of an automatically adjustable bunk apparatus 200 is shown in FIGS. 4A-C and 5A-C. The automatically adjustable bunk apparatus 200 has an adjustable portion 220 that can be positioned relative to the horizontal portion 230 of the automatically adjustable bunk apparatus 200. FIGS. 4A-C show a perspective view of the adjustable portion 220 of the automatically adjustable bunk apparatus 200, adjusting from an extended position (as shown in FIG. 4A) through an intermediate position (as shown in FIG. 4B) to a retracted position (as shown in FIG. 4C). FIGS. 5A-C similarly show a side view of the adjustable portion 220 of the automatically adjustable bunk apparatus 200, adjusting from an extended position (as shown in FIG. 5A) through an intermediate position (as shown in FIG. 5B) to a retracted position (as shown in FIG. 5C). When the adjustable portion 220 is in a retracted position as shown in FIGS. 4C and 5C, the adjustable portion 220 is positioned outside the plane of the horizontal portion 30 and substantially parallel to the horizontal portion 230. FIG. 5 also shows an automatic adjuster 240 that is operative to move the adjustable portion 220 from the extended position (e.g., FIG. 5A) to a retracted position (e.g., FIG. 5C) through a range of intermediate positions (one of which is shown in FIG. 5B). While shown as a solid section in FIGS. 4A-C and 5A-C, the adjustable portion 220 can include, for example, a frame upon which a cushion or other structure can be mounted such that the components that form the adjustable portion 220 and the horizontal portion 230 form a substantially flat surface when the adjustable portion 220 is in the extended position.

Figure 6A:
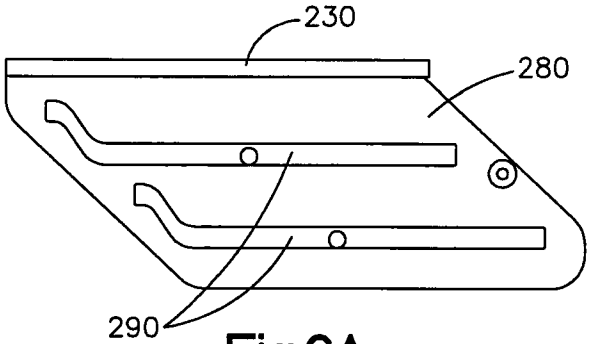
FIG. 6A is a side view of a track for use in guiding an adjustable portion of an automatically adjustable bunk such as those shown in FIGS. 4 and 5 between an extended position and a retracted position.
Figure 6B:
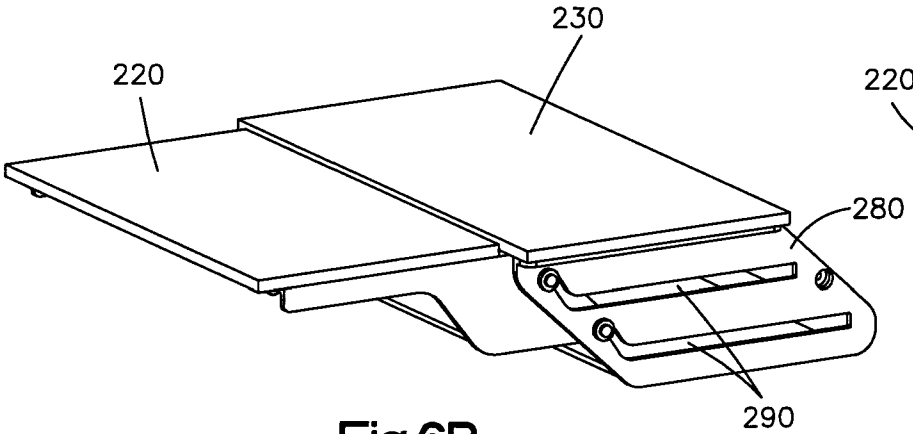
FIGS. 6B, 6C, and 6D are perspective views of an automatically adjustable bunk apparatus using a track for guiding the adjustable portion between an extended position, i.e., configured as a substantially flat surface (FIG. 6B), with the adjustable portion in an intermediate position between a retracted position and an extended position (FIG. 6C), and with the adjustable portion in a retracted position (FIG. 6D).
Figure 6C:
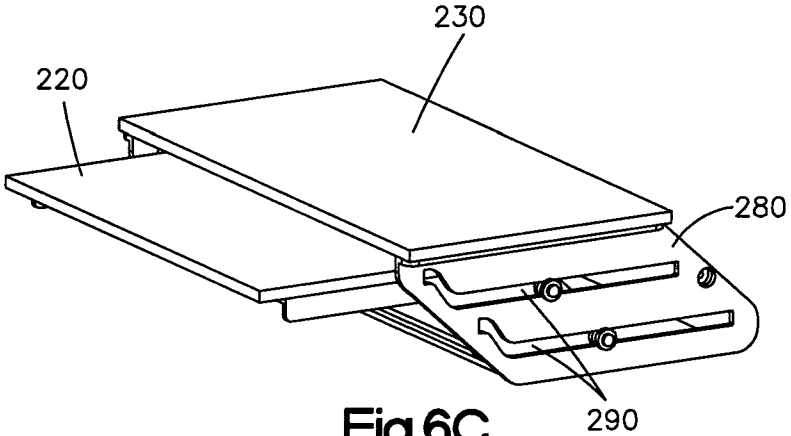
Figure 6D:
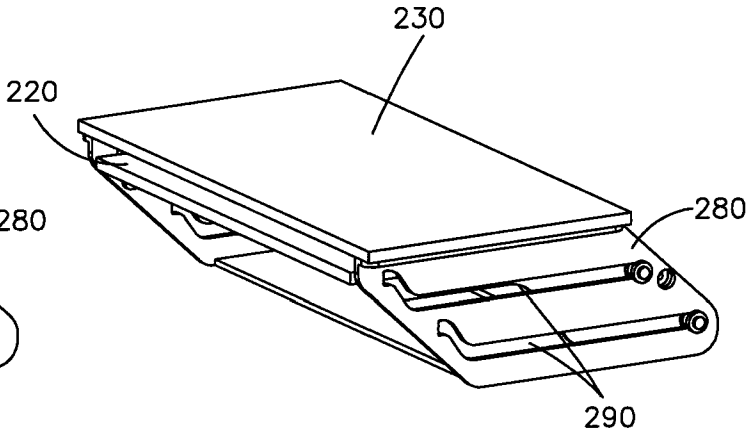

The adjustable portion 220 can be guided between the extended position (e.g., FIG. 5A) and the retracted position (e.g., FIG. 5C) by a guide such as the track 280 with track channels 290 shown in FIG. 6A. Specifically, the adjustable portion 220 can have runner portions that are positioned at the sides of the adjustable portion 220 and are designed to fit within the track channels 290 to guide the adjustable portion 220 between an extended position and a retracted position. An example of a runner portion is a bearing assembly designed to fit within the track channel 290 and provide low frictional contact between the runner portion and the track channel 290. FIGS. 6B, 6C, and 6D show a perspective view of an automatically adjustable bunk apparatus 200 adjusting from an extended configuration (as shown in FIG. 6B) through an intermediate configuration (as shown in FIG. 6C) to a retracted configuration (as shown in FIG. 6D). When the adjustable portion 220 is in a retracted position as shown in FIG. 6B, the adjustable portion 220 is positioned outside the plane of the horizontal portion 230.

The automatic adjuster 240 can include an actuator 260 that is used to drive or actuate a driving portion 270. As discussed above with respect to automatic adjustor 40, an actuator can be, for example, a pneumatic actuator, a hydraulic actuator, or an electric motor actuator and the driving portion can be, for example, a shaft, rod, chain, or cable. As shown in FIGS. 5A-C, the automatic adjuster can include an actuator 260 and a shaft 270 that can be, for example, a shaft or threaded rod depending on the mechanism of the automatic adjuster 220.

Figure 7:
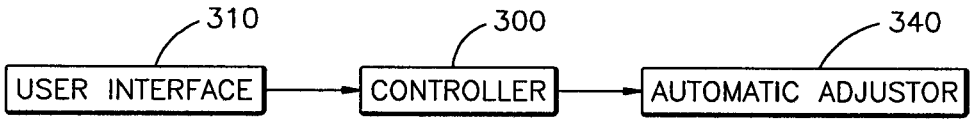
FIG. 7 is a schematic view of a control system for an automatically adjustable seating apparatus such as the automatically adjustable seating apparatus shown in FIGS. 4A-C and 5A-C.

The automatic adjuster 240 is operatively interconnected to a controller 300, shown in FIG. 7. The controller 300 has hardware and/or software configured for operation of the automatic adjustor 240, in the same manner as that discussed above for controller 100, i.e., controller 300 may comprise any suitable programmable logic controller or other control device, or combination of control devices, that is programmed or otherwise configured to perform as recited in the claims. Specifically, the controller 300 controls the automatic adjuster 240 to move the adjustable portion 220 between the retracted position and the extended position as shown in FIGS. 4A-C and 5A-C. The controller 300 includes a user interface 310, which allows an operator to operate the automatically adjustable bunk apparatus 200. The user interface 310 can be one or more devices with which a user can interact, such as, for example, switches, buttons, toggle switches, a computer controlled touch pad, or combinations thereof. The operation of the automatic adjuster 240 can be controlled by a single or multiple user interfaces 310, e.g., one or more switches. The controller 300 can provide a user with the ability to select one or more pre-selected configurations for the automatically adjustable bunk apparatus 200. Further, the controller 300 can provide a user with the ability to adjust the automatically adjustable bunk apparatus 200 to maintain a configuration between the retracted and extended configurations, such as a configuration shown in FIGS. 4B and 5B.

Figure 8A:
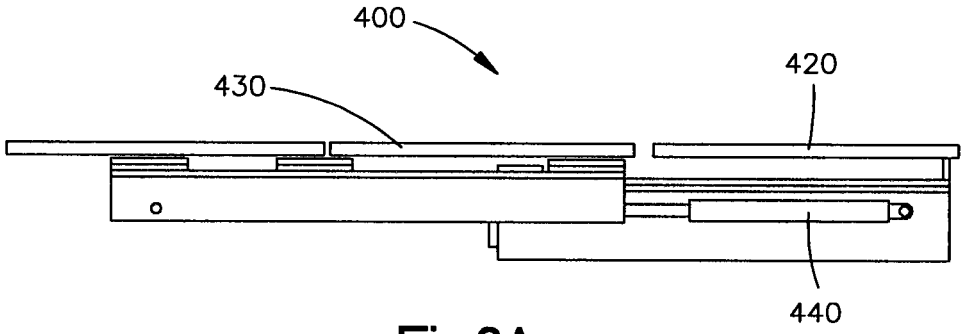
FIGS. 8A-C are side views of an automatically adjustable bunk apparatus with the adjustable portion and horizontal portion in an extended position, i.e., configured as a substantially flat surface (FIG. 8A), with the adjustable portion and horizontal portion in an intermediate position between a retracted position and an extended position (FIG. 8B), and with the adjustable portion and horizontal portion in a retracted position (FIG. 8C).
Figure 8B:
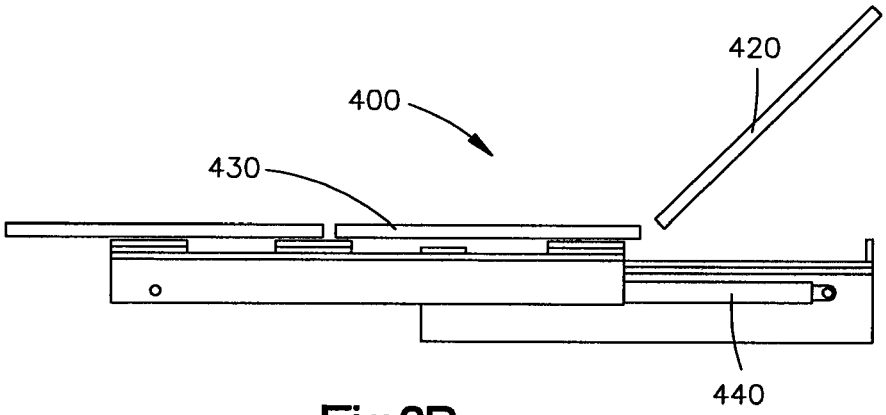
Figure 8C:
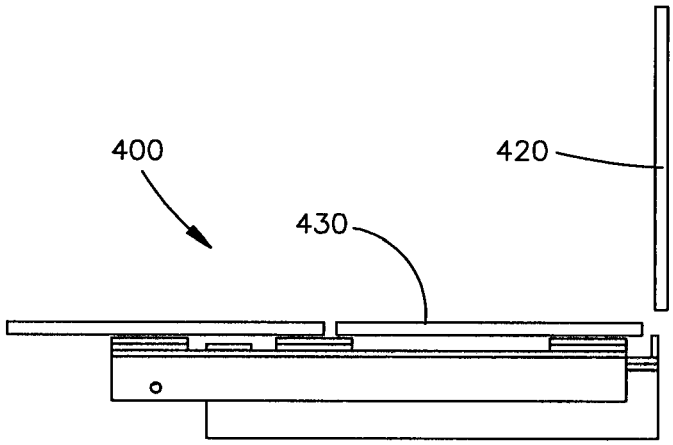

An additional example of an automatically adjustable bunk apparatus further uses a substantially horizontal portion that is moveable between a retracted position and an extended position to form a substantially flat surface when the automatically adjustable bunk apparatus is in the extended position as shown in FIGS. 8A-C. The automatically adjustable bunk apparatus 400 includes an adjustable portion 420 and a horizontal portion 430 that is moveable between a retracted position and an extended position. FIGS. 8A-C show a side view of the automatically adjustable bunk apparatus 400 adjusting from an extended configuration (as shown in FIG. 8A) through an intermediate configuration (as shown in FIG. 8B) to a retracted configuration (as shown in FIG. 8C). When the horizontal portion 430 is in a retracted position as shown in FIG. 8C, the adjustable portion 420 is positioned substantially parallel to the horizontal portion 430. FIG. 8 also shows an automatic adjuster 440 that is operative to move the horizontal portion 430 from the extended position (e.g., FIG. 8A) to the retracted position (e.g., FIG. 8C) through a range of intermediate positions (one of which is shown in FIG. 8B). The adjustable portion 420 moves between a relatively horizontal position in the extended position (e.g., FIG. 8A) and a retracted position (e.g., FIG. 8C). The adjustable portion 420 can be guided between the extended and retracted positions, for example, by a guide 480. The shape of such a guide can be designed to position the adjustable portion 420 in a convenient location when in the retracted position depending on a specific installation within engineering parameters familiar to those of skill in the art.

The automatic adjuster 440 can include an actuator 460 that is used to drive or actuate a driving portion 470. As discussed above with respect to automatic adjustors 40 and 240, an actuator can be, for example, a pneumatic actuator, a hydraulic actuator, or an electric motor actuator and the driving portion can be, for example, a shaft, rod, chain, or cable. As shown in FIGS. 8A-C, the automatic adjuster can include an actuator 460 and a shaft 470 that can be, for example, a shaft or threaded rod depending on the mechanism of the automatic adjuster 420.

Figure 9:
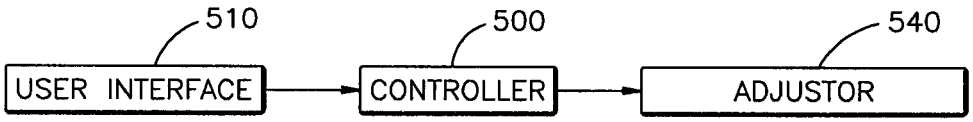
FIG. 9 is a schematic view of a control system for an automatically adjustable seating apparatus such as the automatically adjustable seating apparatus shown in FIGS. 8A-C.

The automatic adjuster 440 is operatively interconnected to a controller 500, shown in FIG. 9. The controller 500 has hardware and/or software configured for operation of the automatic adjustor 440, in the same manner as that discussed above for controllers 100 and 300. Specifically, the controller 500 controls the automatic adjuster 440 to move the adjustable portion 420 between the retracted position and the extended position as shown in FIGS. 8A-C. The controller 500 includes a user interface 510, which allows an operator to operate the automatically adjustable bunk apparatus 400. The user interface 510 can be one or more devices with which a user can interact, such as, for example, switches, buttons, toggle switches, a computer controlled touch pad, or combinations thereof. The operation of the automatic adjuster 440 can be controlled by a single or multiple user interfaces 510, e.g., one or more switches. The controller 500 can provide a user with the ability to select one or more pre-selected configurations for the automatically adjustable bunk apparatus 400. Further, the controller 500 can provide a user with the ability to adjust the automatically adjustable bunk apparatus 400 to maintain a configuration between the retracted and extended configurations, such as a configuration shown in FIG. 8B.

As used herein, the terms substantially flat or substantially flat surface when applied to the surface of the bunk apparatus are intended to mean a surface that is generally parallel or horizontal, i.e., not tilted or sloped. Such a substantially flat surface can be used, for example, for a person to lie down upon or to lay equipment upon. The frame of reference for a surface being generally parallel or horizontal can be, for example, a floor or the deck of a boat. In the example of a surface being parallel or horizontal with reference to the deck of a boat, in use the deck of a boat may not continually be horizontal, i.e., in use or in rough seas the boat may be in constant motion, but the surface will remain substantially flat, i.e., parallel or horizontal with reference to the deck of the boat. The configurations of the automatically adjustable bunk apparatus 10, 200, and 400 shown in FIGS. 1A, 2A, 4A, 5A, 6B and 8A are considered to be substantially flat surfaces within the scope of this description and the claims.

The present invention is not limited in scope by the embodiments disclosed herein which are intended as illustrations of a few aspects of the invention and any embodiments which are functionally equivalent are within the scope of this invention. Various modifications of the apparatus in addition to those shown and described herein will become apparent to those skilled in the art and are intended to fall within the scope of the appended claims. Further, while only certain representative combinations of the apparatus disclosed herein are specifically discussed in the embodiments above, other combinations of the apparatus components will become apparent to those skilled in the art and also are intended to fall within the scope of the appended claims. Thus a combination of components may be explicitly mentioned herein; however, other combinations of components are included, even though not explicitly stated. The term "comprising" and variations thereof as used herein is used synonymously with the term "including" and variations thereof and are open, non-limiting terms.

What is claimed is:

1. An automatically adjustable bunk apparatus comprising:

a substantially horizontal portion; and an adjustable portion, the adjustable portion moveable between a retracted position and an extended position, wherein the adjustable portion is positioned outside the plane of the horizontal portion when the automatically adjustable bunk apparatus is in a refracted configuration, and the horizontal portion and adjustable portion form a substantially flat surface when the automatically adjustable bunk apparatus is in an extended configuration, and wherein the automatically adjustable bunk apparatus allows substantially all floor surface below the adjustable portion to be free of obstructions when the adjustable bunk apparatus is in the extended configuration.

2. The automatically adjustable bunk apparatus of claim 1, wherein the substantially horizontal portion is moveable between a retracted position and an extended position.

3. The automatically adjustable bunk apparatus of claim 1, wherein a portion of the floor area over which the automatically adjustable bunk apparatus is positioned when the automatically adjustable bunk apparatus is in its extended configuration is exposed when the automatically adjustable bunk apparatus is in its retracted configuration.

4. The automatically adjustable bunk apparatus of claim 1, wherein the adjustable portion is pivotally attached to the horizontal portion.

5. The automatically adjustable bunk apparatus of claim 1, wherein the adjustable portion is moveable along a track when the adjustable portion is moved between the extended position and the retracted position.

6. The automatically adjustable bunk apparatus of claim 1, wherein the adjustable portion is positioned substantially perpendicular to the horizontal portion when the adjustable portion is in the retracted position.

7. The automatically adjustable bunk apparatus of claim 1, wherein the adjustable portion is positioned substantially parallel to the horizontal portion when the adjustable portion is in the retracted position.

8. The automatically adjustable bunk apparatus of claim 1, further comprising an automatic adjuster for adjusting the position of the adjustable portion.

9. The automatically adjustable bunk apparatus of claim 8, wherein the automatic adjuster is electrically driven.

10. The automatically adjustable bunk apparatus of claim 8, wherein the automatic adjuster is hydraulically driven.

11. The automatically adjustable bunk apparatus of claim 8, further comprising a controller operatively interconnected with the automatic adjuster for controlling the position of the adjustable portion.

12. The automatically adjustable bunk apparatus of claim 11, wherein the controller is capable of adjusting the adjustable portion to maintain a position between the refracted position and extended position.

13. The automatically adjustable bunk apparatus of claim 11, wherein the controller is capable of activation from one or more positions.

14. The automatically adjustable bunk apparatus of claim 8, wherein the automatic adjuster is an elongate member coupled to the adjustable portion at a first end of the automatic adjuster and coupled to a wall portion or floor portion below the horizontal portion at a second end of the automatic adjuster, and wherein a longitudinal axis of the automatic adjuster is substantially parallel to the horizontal portion or is at an acute angle to the horizontal portion when the automatically adjustable bunk apparatus is in the retracted configuration and when the automatically adjustable bunk apparatus is in the extended configuration.

15. The automatically adjustable bunk apparatus of claim 1, further comprising cushions on the horizontal and adjustable portions.

16. The automatically adjustable bunk apparatus of claim 1, wherein the automatically adjustable bunk apparatus is located on a boat.

17. An automatically adjustable bunk apparatus comprising:

a substantially horizontal portion;

an adjustable portion pivotally attached to the horizontal portion, the adjustable portion moveable between a retracted position and an extended position;

an automatic adjuster for adjusting the position of the adjustable portion; and a controller operatively interconnected with the automatic adjuster for controlling the position of the adjustable portion, wherein the adjustable portion is positioned outside the plane of the horizontal portion when the automatically adjustable bunk apparatus is in a refracted configuration, and the horizontal portion and adjustable portion form a substantially flat surface when the automatically adjustable bunk apparatus is in an extended configuration, and wherein the automatically adjustable bunk apparatus keeps substantially all floor surface below the adjustable portion free from contact with all portions of the automatically adjustable bunk apparatus when the automatically adjustable bunk apparatus is in the extended configuration.

18. The automatically adjustable bunk apparatus of claim 17, wherein the substantially horizontal portion is moveable between a retracted position and an extended position.

19. The automatically adjustable bunk apparatus of claim 17, wherein a portion of the floor area over which the automatically adjustable bunk apparatus is positioned when the automatically adjustable bunk apparatus is in its extended configuration is exposed when the automatically adjustable bunk apparatus is in its refracted configuration.

20. The automatically adjustable bunk apparatus of claim 17, wherein the adjustable portion is positioned substantially perpendicular to the horizontal portion when the adjustable portion is in the retracted position.

21. The automatically adjustable bunk apparatus of claim 17, wherein the automatic adjuster is electrically driven.

22. The automatically adjustable bunk apparatus of claim 17, wherein the automatic adjuster is hydraulically driven.

23. The automatically adjustable bunk apparatus of claim 17, wherein the controller is capable of adjusting the adjustable portion to maintain a position between the refracted position and extended position.

24. The automatically adjustable bunk apparatus of claim 17, further comprising cushions on the horizontal portion and adjustable portion.

25. The automatically adjustable bunk apparatus of claim 17, wherein the adjustable bunk apparatus is located on a boat.

26. The automatically adjustable bunk apparatus of claim 17, wherein the controller is capable of activation from one or more positions.

27. The automatically adjustable bunk apparatus of claim 17, wherein the automatic adjuster is an elongate member coupled to the adjustable portion at a first end of the automatic adjuster and coupled to a wall portion or floor portion below the horizontal portion at a second end of the automatic adjuster, and wherein a longitudinal axis of the automatic adjuster is substantially parallel to the horizontal portion or is at an acute angle to the horizontal portion when the automatically adjustable bunk apparatus is in the retracted configuration and when the automatically adjustable bunk apparatus is in the extended configuration.

* * * * *

UNITED STATES PATENT AND TRADEMARK OFFICE

CERTIFICATE OF CORRECTION

PATENT NO. : 8,499,377 B2
APPLICATION NO. : 12/506453
DATED : August 6, 2013
INVENTOR(S) : Michael J. Fafard et al.

It is certified that error appears in the above-identified patent and that said Letters Patent is hereby corrected as shown below:

In the Claims:

Column 7, line 21, in Claim 1, delete "refracted" and insert -- retracted --, therefor.

Column 7, line 66, in Claim 12, delete "refracted" and insert -- retracted --, therefor.

Column 8, line 34, in Claim 17, delete "refracted" and insert -- retracted --, therefor.

Column 8, line 52, in Claim 19, delete "refracted" and insert -- retracted --, therefor.

Column 8, line 63, in Claim 23, delete "refracted" and insert -- retracted --, therefor.

Signed and Sealed this
Fifth Day of November, 2013

Teresa Stanek Rea

Teresa Stanek Rea
*Deputy Director of the United States Patent and Trademark Office*